US005259982A

United States Patent [19]

Chapple

[11] Patent Number: 5,259,982

[45] **Date of Patent: * Nov. 9, 1993**

[54] DETERGENT COMPOSITIONS

[75] Inventor: Andrew P. Chapple, Wrexham, United Kingdom

[73] Assignee: Lever Brothers Company, Division of Conopco, Inc., New York, N.Y.

[ * ] Notice: The portion of the term of this patent subsequent to Aug. 24, 2010 has been disclaimed.

[21] Appl. No.: 6,012

[22] Filed: Jan. 15, 1993

[30] Foreign Application Priority Data

Jan. 17, 1992 [GB] United Kingdom ..... 9201059.4
Dec. 8, 1992 [GB] United Kingdom ..... 9225610.6

[51] Int. Cl.[5] ..... C11D 3/12; C11D 3/16; C11D 3/395; C11D 17/06

[52] U.S. Cl. ..... 252/95; 252/99; 252/140; 252/174; 252/174.25; 252/186.31; 252/186.38

[58] Field of Search ..... 252/95, 99, 140, 174, 252/174.25, 186.31, 186.38

[56] References Cited

U.S. PATENT DOCUMENTS

| | | | |
|---|---|---|---|
| 3,332,882 | 7/1967 | Blumbergs et al. | 252/186 |
| 4,128,494 | 12/1978 | Schirmann et al. | 252/186 |
| 4,397,757 | 8/1983 | Bright et al. | 252/186.41 |
| 4,412,934 | 11/1983 | Chung et al. | 252/186.28 |
| 4,675,393 | 6/1987 | Coxon | 536/18.6 |
| 4,751,015 | 6/1988 | Humphreys et al. | 252/99 |

FOREIGN PATENT DOCUMENTS

| | | |
|---|---|---|
| 0120591 | 10/1984 | European Pat. Off. . |
| 0174132 | 3/1986 | European Pat. Off. . |
| 0185522 | 6/1986 | European Pat. Off. . |
| 0284292 | 9/1988 | European Pat. Off. . |
| 0303520 | 2/1989 | European Pat. Off. . |
| 0331229 | 9/1989 | European Pat. Off. . |
| 0384070 | 8/1990 | European Pat. Off. . |
| 0425277 | 5/1991 | European Pat. Off. . |
| 0448297 | 9/1991 | European Pat. Off. . |
| 0458396 | 11/1991 | European Pat. Off. . |
| 0464880 | 1/1992 | European Pat. Off. . |
| 0502675 | 9/1992 | European Pat. Off. . |
| 0522726 | 1/1993 | European Pat. Off. . |
| 3337921 | 5/1985 | Fed. Rep. of Germany . |
| 836988 | 6/1960 | United Kingdom . |
| 864798 | 4/1961 | United Kingdom . |
| 907356 | 10/1962 | United Kingdom . |
| 1003310 | 9/1965 | United Kingdom . |
| 1519351 | 7/1978 | United Kingdom . |
| 2123044 | 1/1984 | United Kingdom . |

*Primary Examiner*—Dennis Albrecht
*Attorney, Agent, or Firm*—James J. Farrell

[57] ABSTRACT

A bleaching particulate detergent composition of high bulk density (at least 700 g/l) comprises one or more detergent-active compounds, one or more detergency builders including a specific alkali metal aluminosilicate—maximum aluminium zeolite P (zeolite MAP)—and a bleach system comprising sodium perborate monohydrate. Use of zeolite MAP in place of conventional zeolite 4A in this high bulk density composition improves significantly the storage stability of the sodium perborate monohydrate.

6 Claims, No Drawings

DETERGENT COMPOSITIONS

TECHNICAL FIELD

The present invention relates to a bleaching detergent composition containing crystalline alkali metal aluminosilicate (zeolite) as a detergency builder, and also including sodium perborate monohydrate bleach.

BACKGROUND AND PRIOR ART

The ability of crystalline alkali metal aluminosilicate (zeolite) to sequester calcium ions from aqueous solution has led to its becoming a well-known replacement for phosphates as a detergency builder. Particulate detergent compositions containing zeolite are widely disclosed in the art, for example, in GB 1 473 201 (Henkel), and are sold commercially in many parts of Europe, Japan and the United States of America.

Although many crystal forms of zeolite are known, the preferred zeolite for detergents use has always been zeolite A: other zeolites such as X or P(B) have not found favour because their calcium ion uptake is either inadequate or too slow. Zeolite A has the advantage of being a "maximum aluminium" structure containing the maximum possible proportion of aluminium to silicon—or the theoretical minimum Si:Al ratio of 1.0—so that its capacity for taking up calcium ions from aqueous solution is intrinsically greater than those of zeolite X and P which generally contain a lower proportion of aluminium (or a higher Si:Al ratio).

EP 384 070A (Unilever) describes and claims a novel zeolite P (maximum aluminium zeolite P, or zeolite MAP) having an especially low silicon to aluminium ratio, not greater than 1.33 and preferably not greater than 1.15. This material is demonstrated to be a more efficient detergency builder than conventional zeolite 4A.

EP 448 297A and EP 502 675A (Unilever) disclose detergent formulations containing zeolite MAP with a cobuilder (citrate or polymer), and also containing sodium perborate monohydrate bleach and TAED bleach precursor. Compositions containing zeolite MAP exhibit better detergency than corresponding compositions containing zeolite 4A.

It has now been discovered that replacement of zeolite A by zeolite MAP gives an additional benefit in detergent powders of high bulk density (700 g/1 and above) containing sodium perborate monohydrate bleach: the stability of the sodium perburate monohydrate on storage is significantly increased. This is surprising because the water content of zeolite MAP is not significantly lower than that of zeolite A.

DEFINITION OF THE INVENTION

The present invention provides a particulate bleaching detergent composition having a bulk density of at least 700 g/1 and comprising:

(a) one or more detergent-active compounds, (b) one or more detergency builders including alkali metal aluminosilicate, and (c) a bleach system comprising sodium perborate monohydrate, wherein the alkali metal aluminosilicate comprises zeolite P having a silicon to aluminium ratio not greater than 1.33 (hereinafter referred to as zeolite MAP).

A further subject of the invention is the use of zeolite MAP to improve the stability of sodium perborate monohydrate in a particulate bleaching detergent composition having a bulk density of at least 700 g/1.

DETAILED DESCRIPTION OF THE INVENTION

The subject of the invention is a particulate bleaching detergent composition of high bulk density containing detergent-active compounds, a builder system based on zeolite MAP, and a bleaching system based on sodium perborate monohydrate. These are the essential elements of the invention; other optional detergent ingredients may also be present as desired or required.

A preferred detergent composition in accordance with the invention comprises:

(a) from 5 to 60 wt. % of one or more detergent-active compounds, (b) from 10 to 80 wt. % of one or more detergency builders, including zeolite MAP, (c) a bleach system comprising from 5 to 35 wt. % of sodium perborate monohydrate, and optionally from 1 to 8 wt. % of a bleach precursor, and (d) optionally other detergent ingredients to 100 wt. %, all percentages being based on the detergent composition.

The detergent-active compound

The detergent compositions of the invention will contain, as essential ingredients, one or more detergent-active compounds (surfactants) which may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumas I and II, by Schwartz, Perry and Berch.

The preferred detergent-active compounds that can be used are soaps and synthetic non-soap anionic and nonionic compounds.

Anionic surfactants are Well-known to those skilled in the art. Examples include alkylbenzene sulphonates, particularly linear alkylbenzene sulphonates having an alkyl chain length of $C_8$–$C_{15}$; primary and secondary alkyl sulphates, particularly $C_2$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_{10}$–$C_{20}$ aliphatic alcohols ethoxylated with an average of from 1 to 20 moles of ethylene oxide per mole of alcohol, and more especially the $C_{12}$–$C_{15}$ primary and secondary aliphatic alcohols ethoxylated with an average of from 1 to 10 moles of ethylene oxide per mole of alcohol.

Also of interest are non-ethoxylated nonionic surfactants, for example, alkylpolyglycosides; and O-alkanoyl glucosides as described in EP 423 968A (Unilever).

The choice of detergent-active compound (surfactant), and the amount present, will depend on the intended use of the detergent composition: different surfactant systems may be chosen, as is well known to the skilled formulator, for handwashing products and for products intended for use in different types of washing machine.

The total amount of surfactant present will also depend on the intended end use, but will generally range from 5 to 60 wt. %, preferably from 5 to 40 wt. %.

Detergent compositions suitable for use in most automatic fabric washing machines generally contain anionic non-soap surfactant, or nonionic surfactant, or combinations of the two in any ratio, optionally together with soap.

The detergency builder system

The detergent compositions of the invention also contains one or more detergency builders. The total amount of detergency builder in the compositions will suitably range from 10 to 80 wt. %.

The detergency builder system of the compositions of the invention is based on zeolite MAP, optionally in conjunction with one or more supplementary builders. The amount of zeolite MAP present may suitably range from 5 to 60 wt. %, more preferably from 15 to 40 wt. %.

Preferably, the alkali metal aluminosilicate present in the compositions of the invention consists substantially wholly of zeolite MAP.

Zeolite MAP

Zeolite MAP (maximum aluminium zeolite P) and its use in detergent compositions are described and claimed in EP 384 070A (Unilever). It is defined as an alkali metal aluminosilicate of the zeolite P type having a silicon to aluminium ratio not greater than 1.33, preferably within the range of from 0.9 to 1.33, and more preferably within the range of from 0.9 to 1.2.

Of especial interest is zeolite MAP having a silicon to aluminium ratio not greater than 1.15; and zeolite MAP having a silicon to aluminium ratio not greater than 1.07 is especially preferred.

Zeolite MAP generally has a calcium binding capacity of at least 150 mg CaO per g of anhydrous aluminosilicate, as measured by the standard method described in GB 1 473 201 (Henkel) and also described, as "Method I", in EP 384 070A (Unilever). The calcium binding capacity is normally at least 160 mg CaO/g and may be as high as 170 mg CaO/g. Zeolite MAP also generally has an "effective calcium binding capacity", measured as described under "Method II" in EP 384 070A (Unilever), of at least 145 mg CaO/g, preferably at least 150 mg CaO/g.

Although zeolite MAP like other zeolites contains water of hydration, for the purposes of the present invention amounts and percentages of zeolite are generally expressed in terms of the notional anhydrous material. The amount of water present in hydrated zeolite MAP at ambient temperature and humidity is normally about 20 wt. %.

Particle size of the zeolite MAP

Preferred zeolite MAP for use in the present invention is especially finely divided and has a $d_{50}$ (as defined below) within the range of from 0.1 to 5.0 micrometers, more preferably from 0.4 to 2.0 micrometers and most preferably from 0.4 to 1.0 micrometers.

The quantity "$d_{50}$" indicates that 50 wt. % of the particles have a diameter smaller than that figure, and there are corresponding quantities "$d_{80}$", "$d_{90}$" etc. Especially preferred materials have a $d_{90}$ below 3 micrometers as well as a $d_{50}$ below 1 micrometer.

Various methods of measuring particle size are known, and all give slightly different results. In the present specification, the particle size distributions and average values (by weight) quoted were measured by means of a Malvern Mastersizer (Trade Mark) with a 45 mm lens, after dispersion in demineralised water and ultrasonification for 10 minutes.

Advantageously, but not essentially, the zeolite MAP may have not only a small average particle size, but may also contain a low proportion, or even be substantially free, of large particles. Thus the particle size distribution may advantageously be such that at least 90 wt. % and preferably at least 95 wt. % are smaller than 10 micrometers; at least 85 wt. % and preferably at least 90 wt. % are smaller than 6 micrometers; and at least 80 wt. % and preferably at least 85 wt. % are smaller than 5 micrometers.

Other builders

The zeolite MAP may, if desired, be used in conjunction with other inorganic or organic builders. However, the presence of significant amounts of zeolite A is not preferred.

Inorganic builders that may be present include sodium carbonate, if desired in combination with a crystallisation seed for calcium carbonate, as disclosed in GB 1 437 950 (Unilever). Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. This list is not intended to be exhaustive.

Builders, both inorganic and organic, are preferably present in alkali metal salt, especially sodium salt, form.

Preferred supplementary builders for use in conjunction with zeolite MAP include citric acid salts, more especially sodium citrate, suitably used in amounts of from 3 to 20 wt. %, more preferably from 5 to 15 wt. %. This builder combination is described and claimed in EP 448 297A (Unilever).

Also preferred are polycarboxylate polymers, more especially acrylic/maleic copolymers, suitably used in amounts of from 0.5 to 15 wt. %, especially from 1 to 10 wt. %, of the detergent composition; this builder combination is described and claimed in EP 502 675A (Unilever).

The bleach system

Detergent compositions according to the invention contain a bleach system, which is based on the inorganic persalt, sodium perborate monohydrate. This is an especially effective bleach compound in view of its high active oxygen content and its high rate of dissolution in the wash liquor.

Sodium perborate monohydrate is suitably present in an amount of from 5 to 35 wt. %, preferably from 10 to 25 wt. %, based on the detergent composition.

If desired, the bleach system may also comprise a bleach precursor.

Peroxyacid bleach precursors are known and amply described in the literature, for example, GB 836 988, GB 864 798, GB 907 356, GB 1 003 310, GB 1 519 351, DE 3 337 921A, EP 185 522A, EP 174 132A, EP 120 591A, U.S. Pat. No. 1,246,339, U.S. Pat. No. 3,332,882, U.S. Pat. No. 4,128,494 , U.S. Pat. No. 4,412,934 and U.S. Pat. No. 4,675,393.

Preferred bleach precursors are peroxycarboxylic acid precursors, more especially peracetic acid precursors and peroxybenzoic acid precursors; and peroxycarbonic acid precursors.

One class of especial interest is formed by the quaternary ammonium- and phosphonium-substituted bleach precursors, for example, as disclosed in U.S. Pat. No. 4,751,015 and U.S. Pat. No. 4,397,757 (Lever Brothers Company), and EP 284 292A and EP 331 229A (Unilever). A preferred peroxyacid bleach precursor of this class is 2-(N,N,N-trimethyl ammonium) ethyl sodium-4-sulphophenyl carbonate chloride (SPCC), also known as cholyl-p-sulphophenyl carbonate (CSPC).

Examples of other preferred peroxyacid bleach precursors for use in the present invention include:

sodium 4-benzoyloxybenzene sulphonate (SBOBS);
N,N,N',N'-tetracetyl ethylenediamine (TAED);
sodium 1-methyl-2-benzoyloxybenzene-4-sulphonate;
sodium 4-methyl-3-benzoyloxy benzoate;
trimethylammonium toluyloxybenzene sulphate;
sodium nonanoyloxybenzene sulphonate (SNOBS);
sodium 3,5,5-trimethylhexanoyloxybenzene sulphonate (STHOBS);
and the substituted cationic nitriles disclosed in EP 284 292A, EP 303 520A, EP 458 396A and EP 464 880A (Kao).

Bleach precursors are suitably present in an amount of from 1 to 8 wt. %, preferably from 2 to 5 wt. %.

Particulate bleaching detergent compositions having a bulk density of at least 700 g/l and containing a builder system comprising zeolite MAP and a bleach system comprising a peroxy bleach compound and a bleach precursor are the subject of our copending application of even date (Case C3488).

Other ingredients

Other materials that may be present in detergent compositions of the invention include sodium silicate; antiredeposition agents such as cellulosic polymers; fluorescers; inorganic salts such as sodium sulphate; lather control agents or lather boosters as appropriate; pigments; and perfumes. This list is not intended to be exhaustive.

Bulk density

The particulate detergent compositions of the invention have a bulk density of at least 700 g/l, and preferably at least 800 g/l.

Preparation of the detergent compositions

The particulate detergent compositions of the invention may be prepared by any method suitable for the production of high bulk density powders.

One suitable method comprises spray-drying a slurry of compatible heat-insensitive ingredients, including the zeolite MAP, any other builders, and at least part of the detergent-active compounds: densifying the resulting base powder in a batch or continuous high-speed mixer/granulator; and then spraying on or postdosing those ingredients unsuitable for processing via the slurry, including the sodium perborate monohydrate and any other bleach ingredients.

In another method, especially preferred, the spray-drying step can be omitted altogether, the high bulk density base powder being prepared directly from its constituent raw materials, by mixing and granulating in a high-speed mixer/granulator, and then postdosing bleach and other ingredients as in the spray-drying-/post-tower deification route.

Processes using high-speed mixer/granulators are disclosed, for example, in EP 340 013A, EP 367 339A, EP 390 251A and EP 420 317A (Unilever).

EXAMPLES

The invention is further illustrated by the following Examples, in which parts and percentages are by weight unless otherwise indicated. Examples identified by numbers are in accordance with the invention, while those identified by letters are comparative.

The zeolite MAP used in the Examples was prepared by a method similar to that described in Examples 1 to 3 of EP 384 070A (Unilever). Its silicon to aluminium ratio was 1.07. Its particle size ($d_{50}$) as measured by the Malvern Mastersizer was 0.8 micrometers.

The zeolite A used was Wessalith (Trade Mark) P powder ex Degussa.

The anionic surfactant used was coconut alcohol sulphate (cocoPAS) ex Philippine Refining Co.. The nonionic surfactants used were Synperonic (Trade Mark) A7 and A3 ex ICI, which are $C_{12}$–$C_{15}$ alcohols ethoxylated respectively with an average of 7 and 3 moles of ethylene oxide.

EXAMPLE 1, COMPARATIVE EXAMPLE A

Detergent base powders were prepared to the formulations given below (in parts by weight), by mixing and granulating in a Fukae (Trade Mark) batch high-speed mixer/granulator.

| | 1 | A |
|---|---|---|
| CocoPAS | 5.10 | 5.10 |
| Nonionic surfactant 7EO | 4.80 | 4.80 |
| Nonionic surfactant 3EO | 7.10 | 7.10 |
| Zeolite 4A (as anhydrous*) | — | 27.00 |
| Zeolite MAP (as anhydrous*) | 25.00 | — |
| Sodium carbonate | — | 15.00 |
| SCMC | 0.50 | 0.50 |
| Fluorescer | 0.21 | 0.21 |
| Moisture (nominal) | 6.25 | 6.75 |
| | 48.96 | 66.46 |
| Bulk density (g/l) | 808 | 816 |

*The zeolites were used in hydrated from, but the amounts are quoted in terms of anhydrous material, the water of hydration being included in the amount shown for total moisture.

The actual moisture contents of the base powders were determined by measuring weight loss after heating to 135° C. for 1 hour, and were found to be as follows:

Moisture (wt. %) 8.6 6.5

Thus the base powder containing zeolite MAP had a slightly higher moisture content.

Powder samples were prepared by mixing 1.25 g of sodium perborate monohydrate with 8.75 g of each base powder. Each powder therefore contained 87.50 wt. % base powder and 12.50 wt. % sodium perborate monohydrate.

The products were stored in open bottles at 37° C./70% relative humidity. Storage stabilities were assessed by removing samples at different time intervals and measuring their residual available oxygen content by titration with potassium permanganate. The results, expressed as percentages of the initial value, were as follows:

| Storage time (days) | 1 | A |
|---|---|---|
| 0 | 100 | 100 |
| 7 | 92.6 | 85.4 |
| 14 | 83.1 | 69.1 |
| 28 | 66.3 | 53.5 |

Thus better sodium perborate monohydrate stability was exhibited in the zeolite-MAP-containing powder, despite its higher moisture content.

I claim:

1. A particulate bleaching detergent composition having a bulk density of at least 700 g/l, comprising:

(a) from 5 to 60 wt. % of one or more surfactant compounds, (b) from 10 to 80 wt. % of one or more detergency builders including alkali metal aluminosilicate, and (c) a bleach system comprising from 5 to 35 wt. % of sodium perborate monohydrate and optionally from 2 to 8 wt. % of a bleach precursor, wherein the alkali metal aluminosilicate comprises zeolite P having a silicon ration not greater than 1.33 (zeolite MAP) and a particle size d50 of from 0.1 to 5.0 micrometers, said zeolite MAP being present in an amount of about 15–40 wt. % all percentages being based on the detergent composition.

2. A detergent composition as claimed in claim 1, wherein the zeolite MAP has a silicon to aluminium ration not greater than 1.15.

3. A detergent composition as claimed in claim 2, wherein the zeolite MAP has a silicon to aluminium ration not greater than 1.07.

4. A detergent composition as claimed in claim 1, which is substantially free of zeolite A.

5. A detergent composition as claimed in claim 1, which further comprises an effective amount of a bleach precursor.

6. A detergent composition as claimed in claim 1, having a bulk density of at least 800 g/l.

* * * * *